US008820114B2

(12) United States Patent
Charamko et al.

(10) Patent No.: US 8,820,114 B2
(45) **Date of Patent: *Sep. 2, 2014**

(54) COOLING OF HEAT INTENSIVE SYSTEMS

(75) Inventors: Serguei Charamko, Novato, CA (US); Kristian Debus, Petaluma, CA (US); Tom Gielda, St. Joseph, MI (US)

(73) Assignee: PAX Scientific, Inc., San Rafael, CA (US)

( * ) Notice: Subject to any disclaimer, the term of this patent is extended or adjusted under 35 U.S.C. 154(b) by 600 days.

This patent is subject to a terminal disclaimer.

(21) Appl. No.: 13/039,121

(22) Filed: Mar. 2, 2011

(65) Prior Publication Data

US 2012/0000631 A1 Jan. 5, 2012

Related U.S. Application Data

(63) Continuation-in-part of application No. 12/732,171, filed on Mar. 25, 2010, now Pat. No. 8,333,080, and a continuation-in-part of application No. 12/945,799, filed on Nov. 12, 2010, now abandoned, and a continuation-in-part of application No. 13/028,089, filed on Feb. 15, 2011.

(60) Provisional application No. 61/163,438, filed on Mar. 25, 2009, provisional application No. 61/228,557, filed on Jul. 25, 2009.

(51) Int. Cl.

| | |
|---|---|
| ***F25B 3/00*** | (2006.01) |
| ***F25B 9/02*** | (2006.01) |
| ***F25B 1/00*** | (2006.01) |
| ***F25B 1/06*** | (2006.01) |
| *F28D 11/04* | (2006.01) |
| *F28D 21/00* | (2006.01) |

(52) U.S. Cl.

CPC ..... *F25B 1/06* (2013.01); *F28F 2250/08* (2013.01); *F28F 2265/14* (2013.01); *F28D 11/04* (2013.01); *F28D 2021/0028* (2013.01)

USPC ..... 62/500; 62/5; 62/116

(58) Field of Classification Search

CPC ..... F25B 1/06; F25B 1/08; F25B 9/08; F25B 2341/001; F04D 21/00

USPC ..... 62/61, 116, 500

See application file for complete search history.

(56) References Cited

U.S. PATENT DOCUMENTS

| | | | |
|---|---|---|---|
| 1,860,447 | A | 5/1932 | Bergdoll |
| 2,116,480 | A | 5/1938 | Russell |

(Continued)

FOREIGN PATENT DOCUMENTS

| | | |
|---|---|---|
| EP | 1 080 648 A2 | 7/2001 |
| EP | 1 720 012 | 11/2006 |

(Continued)

OTHER PUBLICATIONS

PCT Application No. PCT/US2010/28761, International Search Report and Written Opinion mailed Jun. 16, 2010, 6pgs.

(Continued)

*Primary Examiner* — Mohammad M Ali
*Assistant Examiner* — Daniel C Comings
(74) *Attorney, Agent, or Firm* — Lewis Roca Rothgerber LLP

(57) ABSTRACT

Disclosed herein is a cooling system that utilizes a supersonic cooling cycle. The cooling system includes accelerating a compressible working fluid, and may not require the use of a conventional mechanical pump. The cooling system accelerates the fluid to a velocity equal to or greater than the speed of sound in the compressible fluid selected to be used in the system. A phase change of the fluid due at least in part to a pressure differential cools a working fluid that may be utilized to transfer heat from a heat intensive system.

18 Claims, 12 Drawing Sheets

(56) References Cited

U.S. PATENT DOCUMENTS

| | | | | |
|---|---|---|---|---|
| 2,928,779 | A | | 3/1960 | Weills et al. |
| 3,228,848 | A | | 1/1966 | Fellows |
| 3,425,486 | A | | 2/1969 | Burton et al. |
| 3,510,266 | A | | 5/1970 | Midler, Jr. |
| 3,548,589 | A | | 12/1970 | Cooke-Yarborough |
| 3,552,120 | A | | 1/1971 | Beale |
| 3,621,667 | A | * | 11/1971 | Mokadam ..... 62/116 |
| 3,866,433 | A | | 2/1975 | Krug |
| 4,031,712 | A | | 6/1977 | Costello |
| 4,044,558 | A | | 8/1977 | Benson |
| 4,057,962 | A | | 11/1977 | Belaire |
| 4,089,187 | A | | 5/1978 | Schumacher et al. |
| 4,201,263 | A | | 5/1980 | Anderson |
| 4,333,796 | A | | 6/1982 | Flynn |
| 4,442,675 | A | | 4/1984 | Wilensky |
| 4,858,155 | A | | 8/1989 | Okawa et al. |
| 4,859,347 | A | | 8/1989 | Simon et al. |
| 4,998,415 | A | | 3/1991 | Larsen |
| 5,074,759 | A | | 12/1991 | Cossairt |
| 5,083,429 | A | | 1/1992 | Veres et al. |
| 5,205,648 | A | | 4/1993 | Fissenko |
| 5,275,486 | A | | 1/1994 | Fissenko |
| 5,317,905 | A | | 6/1994 | Johnson |
| 5,338,113 | A | | 8/1994 | Fissenko |
| 5,343,711 | A | | 9/1994 | Kornhauser et al. |
| 5,353,602 | A | | 10/1994 | Pincus |
| 5,431,346 | A | | 7/1995 | Sinaisky |
| 5,467,613 | A | | 11/1995 | Brasz |
| 5,544,961 | A | | 8/1996 | Fuks et al. |
| 5,647,221 | A | | 7/1997 | Garris, Jr. |
| 5,659,173 | A | | 8/1997 | Putterman et al. |
| 5,810,037 | A | | 9/1998 | Sasaki et al. |
| 5,980,698 | A | | 11/1999 | Abrosimov |
| 6,105,382 | A | | 8/2000 | Reason |
| 6,170,289 | B1 | | 1/2001 | Brown |
| 6,190,498 | B1 | | 2/2001 | Blagborne |
| 6,280,578 | B1 | | 8/2001 | Popov |
| 6,398,918 | B1 | | 6/2002 | Popov |
| 6,604,376 | B1 | | 8/2003 | Demarco et al. |
| 6,655,165 | B1 | | 12/2003 | Eisenhour |
| 6,719,817 | B1 | | 4/2004 | Marin |
| 6,739,141 | B1 | | 5/2004 | Sienel et al. |
| 6,796,704 | B1 | | 9/2004 | Lott |
| 6,835,484 | B2 | | 12/2004 | Fly |
| 6,889,754 | B2 | | 5/2005 | Kroliczek et al. |
| 6,935,845 | B2 | | 8/2005 | Berner et al. |
| 7,004,240 | B1 | | 2/2006 | Kroliczek et al. |
| 7,131,294 | B2 | | 11/2006 | Manole |
| 7,178,353 | B2 | | 2/2007 | Cowans et al. |
| 7,251,889 | B2 | | 8/2007 | Kroliczek et al. |
| 7,381,241 | B2 | | 6/2008 | Tessien et al. |
| 7,387,093 | B2 | | 6/2008 | Hacsi |
| 7,387,660 | B2 | | 6/2008 | Tessien et al. |
| 7,393,342 | B2 | | 7/2008 | Henniges et al. |
| 7,399,545 | B2 | | 7/2008 | Fly |
| 7,415,835 | B2 | | 8/2008 | Cowans et al. |
| 7,448,790 | B2 | | 11/2008 | Tessien et al. |
| 7,549,461 | B2 | | 6/2009 | Kroliczek et al. |
| 7,654,095 | B2 | | 2/2010 | Sullivan |
| 7,656,808 | B2 | | 2/2010 | Manthoulis et al. |
| 7,708,053 | B2 | | 5/2010 | Kroliczek et al. |
| 7,721,569 | B2 | | 5/2010 | Manole |
| 7,726,135 | B2 | | 6/2010 | Sullivan |
| 7,765,820 | B2 | | 8/2010 | Cowans et al. |
| 7,796,389 | B2 | | 9/2010 | Edmunds et al. |
| 8,087,880 | B2 | | 1/2012 | Karafillis et al. |
| 8,333,080 | B2 | | 12/2012 | Harman et al. |
| 8,353,168 | B2 | | 1/2013 | Harman et al. |
| 8,353,169 | B2 | | 1/2013 | Harman et al. |
| 8,359,872 | B2 | | 1/2013 | Harman et al. |
| 8,365,540 | B2 | | 2/2013 | Harman et al. |
| 8,505,322 | B2 | | 8/2013 | Gielda et al. |
| 8,506,254 | B2 | | 8/2013 | Muller |
| 2001/0042380 | A1 | | 11/2001 | Cho et al. |
| 2002/0090047 | A1 | | 7/2002 | Stringham |
| 2002/0177035 | A1 | | 11/2002 | Oweis et al. |
| 2003/0126883 | A1 | | 7/2003 | Saito et al. |
| 2004/0009382 | A1 | | 1/2004 | Fly |
| 2004/0123614 | A1 | | 7/2004 | Stewart |
| 2004/0172966 | A1 | | 9/2004 | Ozaki et al. |
| 2005/0005617 | A1 | | 1/2005 | Jibb |
| 2005/0048339 | A1 | | 3/2005 | Fly |
| 2006/0018419 | A1 | | 1/2006 | Tessien |
| 2006/0018420 | A1 | | 1/2006 | Tessien |
| 2006/0032625 | A1 | | 2/2006 | Angelis et al. |
| 2006/0191049 | A1 | | 8/2006 | Elkins et al. |
| 2007/0028646 | A1 | | 2/2007 | Oshitani et al. |
| 2007/0199333 | A1 | | 8/2007 | Windisch |
| 2007/0271939 | A1 | | 11/2007 | Ichigaya |
| 2008/0006051 | A1 | | 1/2008 | Johnson |
| 2008/0057382 | A1 | | 3/2008 | Kimura |
| 2008/0060378 | A1 | | 3/2008 | Gocho et al. |
| 2008/0105315 | A1 | | 5/2008 | Botros et al. |
| 2008/0277098 | A1 | | 11/2008 | Fly |
| 2008/0292948 | A1 | | 11/2008 | Kumar et al. |
| 2009/0199997 | A1 | | 8/2009 | Koplow |
| 2009/0266516 | A1 | | 10/2009 | Jewell-Larsen et al. |
| 2009/0272128 | A1 | | 11/2009 | Ali |
| 2009/0293513 | A1 | | 12/2009 | Sullivan |
| 2010/0043633 | A1 | | 2/2010 | Galbraith |
| 2010/0090469 | A1 | | 4/2010 | Sullivan |
| 2010/0126212 | A1 | | 5/2010 | May |
| 2010/0154445 | A1 | | 6/2010 | Sullivan |
| 2010/0180631 | A1 | | 7/2010 | Roisin et al. |
| 2010/0287954 | A1 | | 11/2010 | Harman et al. |
| 2011/0030390 | A1 | | 2/2011 | Charamko et al. |
| 2011/0048048 | A1 | | 3/2011 | Gielda et al. |
| 2011/0048062 | A1 | | 3/2011 | Gielda et al. |
| 2011/0048066 | A1 | | 3/2011 | Gielda et al. |
| 2011/0051549 | A1 | | 3/2011 | Debus et al. |
| 2011/0088419 | A1 | | 4/2011 | Harman et al. |
| 2011/0088878 | A1 | | 4/2011 | Harman et al. |
| 2011/0094249 | A1 | | 4/2011 | Harman et al. |
| 2011/0113792 | A1 | | 5/2011 | Harman et al. |
| 2011/0117511 | A1 | | 5/2011 | Harman et al. |
| 2011/0139405 | A1 | | 6/2011 | Harman et al. |
| 2012/0118538 | A1 | | 5/2012 | Gielda et al. |
| 2012/0205080 | A1 | | 8/2012 | Debus et al. |
| 2012/0260673 | A1 | | 10/2012 | Charamko et al. |
| 2012/0260676 | A1 | | 10/2012 | Charamko et al. |
| 2012/0285661 | A1 | | 11/2012 | Gielda et al. |
| 2012/0297800 | A1 | | 11/2012 | Debus et al. |
| 2012/0301268 | A1 | | 11/2012 | Gielda et al. |
| 2012/0312379 | A1 | | 12/2012 | Gielda et al. |
| 2014/0054161 | A1 | | 2/2014 | Harman et al. |

FOREIGN PATENT DOCUMENTS

| | | | |
|---|---|---|---|
| GB | 2 473 981 | | 2/2012 |
| JP | 60-175980 | | 9/1985 |
| JP | 2002130770 | | 5/2002 |
| JP | 2003021410 | | 1/2003 |
| JP | 2003034135 | | 2/2003 |
| JP | 2005-240689 | | 9/2005 |
| JP | 2009-221883 | | 10/2009 |
| WO | 2004072567 | A2 | 8/2004 |
| WO | WO 2006/054408 | | 5/2006 |
| WO | 2006137850 | A2 | 12/2006 |
| WO | 2009070728 | A1 | 6/2009 |
| WO | 2009123674 | A2 | 10/2009 |
| WO | 2010042467 | A2 | 4/2010 |
| WO | WO 2010/111560 | | 9/2010 |
| WO | WO 2011/119338 | | 9/2011 |
| WO | WO 2012/018627 | | 2/2012 |
| WO | WO 2012/065169 | | 5/2012 |
| WO | WO 2012/097192 | | 7/2012 |
| WO | WO 2012/097193 | | 7/2012 |

OTHER PUBLICATIONS

Energy Efficiency Manual, "Compression Cooling," D.R. Wulfinghoff, 1999, pp. 1299-1321.

(56) References Cited

OTHER PUBLICATIONS

M. Guglielmone et al., Heat Recovery from Vapor Compression Air Conditioning: A Brief Introduction, Turbotec Products, Inc., May 14, 2008.
Robert H. Turner, "Water Consumption of Evaporative Cooling Systems," 21st Intersociety Energy Conversation Engineering Conference, San Diego, California, Aug. 25-29, 1986.
S. Klein et al., "Solar Refrigeration," American Society of Heating, Refrigerating and Conditioning Engineers, Inc., ASHRAE Journal, vol. 47, No. 9, Sep. 2005.
NASA Tech Briefs, "Vapor-Compression Solar Refrigerator Without Batteries," Sep. 2001, http://www.techbriefs.com/component/content/article/7426.
Wikipedia, "Stirling engine," http://en.wikipedia.org/wiki/Stirling_engine, visited May 3, 2010.
Fox, et al., "Supersonic Cooling by Shock-Vortex Interaction," J. Fluid Mech. 1996, vol. 308, pp. 363-379.
Hu, et al., "Numerical and Experimental Study of a Hydrodynamic Cavitation Tube," Metallurgical and Materials Transactions B, vol. 29B, Aug. 1998.
Mishra, et al., "Development of Cavitation in Refrigerant (R-123) Flow Inside Rudimentary Microfluidic Systems," Journal of Microelectromechanical Systems, vol. 15, No. 5, Oct. 2006.
Non-final office action mailed Feb. 4, 2011 in U.S. Appl. No. 12/960,979.
Non-final office action mailed Feb. 16, 2011 in U.S. Appl. No. 12/961,015.
Non-final office action mailed Feb. 1, 2011 in U.S. Appl. No. 12/961,342.
Combined search and examination report mailed Jan. 21, 2011 in U.K. patent application No. GB1021925.1.
U.S. Appl. No. 12/876,985, Jayden David Harman, System and Method for Heat Transfer, filed Sep. 7, 2010.
U.S. Appl. No. 12/945,799, Thomas Gielda, Pump-Less Cooling, filed Nov. 12, 2010.
U.S. Appl. No. 13/028,089, Kristian Debus, Pump-Less Cooling Using a Rotating Disk, filed Feb. 15, 2011.
U.S. Appl. No. 13/028,083, Thomas Gielda, Supersonic Cooling with a Pulsed Inlet, filed Feb. 15, 2011.
U.S. Appl. No. 12/960,979, Jayden David Harman, Thermodynamic Cycle for Cooling a Working Fluid, filed Dec. 6, 2010.
U.S. Appl. No. 12/961,015, Jayden David Harman, Pressure Shock-Induced Cooling Cycle, filed Dec. 6, 2010.
U.S. Appl. No. 12/961,342, Jayden David Harman, Supersonic Cooling System, filed Dec. 6, 2010.
U.S. Appl. No. 12/961,366, Jayden David Harman, Heat Exchange and Cooling Systems, filed Dec. 6, 2010.
U.S. Appl. No. 12/961,386, Jayden David Harman, Heating and Cooling of Working Fluids, filed Dec. 6, 2010.
PCT Application No. PCT/US2012/021140, International Search Report mailed Jun. 12, 2012, 3pgs.
PCT Application No. PCT/US2012/021139, International Search Report mailed Aug. 14, 2012, 3pgs.
U.S. Appl. No. 12/732,171, Office Action mailed Jan. 23, 2012.
U.S. Appl. No. 12/876,985, Office Action mailed Feb. 29, 2012.
U.S. Appl. No. 12/880,940, Office Action mailed Sep. 19, 2012.
U.S. Appl. No. 12/902,056, Office Action mailed Sep. 14, 2012.
U.S. Appl. No. 12/902,060, Office Action mailed Sep. 26, 2012.
U.S. Appl. No. 12/960,979, Office Action mailed Mar. 9, 2012.
U.S. Appl. No. 12/961,015, Office Action mailed Jul. 3, 2012.
U.S. Appl. No. 12/961,015, Final Office Action mailed Dec. 9, 2011.
U.S. Appl. No. 12/961,342, Office Action mailed Dec. 13, 2011.
U.S. Appl. No. 12/961,366, Final Office Action mailed Aug. 31, 2012.
U.S. Appl. No. 12/961,366, Office Action mailed Feb. 24, 2012.
U.S. Appl. No. 12/961/386, Final Office Action mailed Dec. 13, 2011.
U.S. Appl. No. 13/048,633, David Halt, Supersonic Cooling Nozzle With Airfoils, filed Mar. 15, 2011.
U.S. Appl. No. 131087,062, Serguei Charamko, Cooling System Utilizing a Reciprocating Piston, filed Apr. 14, 2011.
U.S. Appl. No. 13/088,593, Serguei Charamko, Cooling System Utilizing a Conical Body, filed Apr. 18, 2011.
U.S. Appl. No. 13/113,626, Kristian Debus et al., Supersonic Cooling Nozzle Inlet, filed May 23, 2011.
U.S. Appl. No. 13/115,930, Tom Gielda, Supersonic Cooling with Pulsed Inlet and Bypass Loop, filed May 25, 2011.
International Preliminary Report on Patentability mailed on Aug. 19, 2011 in Patent Cooperation Treaty application No. PCT/US2010/028761 filed Mar. 25, 2010.
International Search Report mailed Jul. 25, 2011 in Patent Cooperation Treaty application No. PCT/US2011/027845 filed Mar. 10, 2011.
"Nozzle Applet" Published by Virginia Polytechnic Institute and State University (Virginia Tech) and retrieved on May 10, 2011 at http://www.engapplets.vt.edu/fluids/CDnozzle/cdinfo.html.
Interview Summary mailed Mar. 16, 2011 in U.S. Appl. No. 12/960,979, filed Dec. 6, 2010.
Final Office Action mailed May 19, 2011 in U.S. Appl. No. 12/960,979, filed Dec. 6, 2010.
Interview Summary mailed Mar. 10, 2011 in U.S. Appl. No. 12/961,015, filed Dec. 6, 2010.
Interview Summary mailed Mar. 18, 2011 in U.S. Appl. No. 12/961,342, filed Dec. 6, 2010.
Final Office Action mailed May 17, 2011 in U.S. Appl. No. 121961,342, filed Dec. 6, 2010.
Interview Summary mailed Jul. 13, 2011 in U.S. Appl. No. 12/961,342, filed Dec. 6, 2010.
Office Action mailed Mar. 18, 2011 in U.S. Appl. No. 12/961,386, filed Dec. 6, 2010.
PCT Application No. PCT/US11/45376 International Search Report and Written Opinion mailed Dec. 23, 2011.
PCT Application No. PCT/US11/060615 International Search Report and Written Opinion mailed Mar. 23, 2012.
PCT Application No. PCT/US2012/021140, Written Opinion mailed Jun. 12, 2012.
PCT Application No. PCT/US2012/021139, Written Opinion mailed Aug. 14, 2012.
Chinese Patent Application No. 2010-080022994.7, Office Action dated Aug. 14, 2013.
U.S. Appl. No. 12/753,824, Office Action mailed May 8, 2013.
U.S. Appl. No. 12/961,015, Final Office Action mailed Feb. 25, 2013.
U.S. Appl. No. 12/843,834, Office Action mailed Jul. 12, 2013.
U.S. Appl. No. 12/961,366, Office Action mailed Apr. 15, 2013.
U.S. Appl. No. 13/115,930, Office Action mailed Apr. 2, 2013.

* cited by examiner

COOLING OF HEAT INTENSIVE SYSTEMS

CROSS-REFERENCE TO RELATED APPLICATIONS

This application is a continuation-in-part, and claims the priority benefit of, U.S. patent application Ser. No. 12/732,171, filed Mar. 25, 2010 now U.S. Pat. No. 8,333,080, which claims the priority benefit of U.S. provisional application No. 61/163,438 filed Mar. 25, 2009, and 61/228,557 filed Jul. 25, 2009; this application is also a continuation-in-part, and claims the priority benefit of, U.S. patent application Ser. No. 12/945,799, filed Nov. 12, 2010 now abandoned, and Ser. No. 13/028,089, filed Feb. 15, 2011. The disclosure of each of the aforementioned applications is incorporated herein by reference.

BACKGROUND OF THE INVENTION

1. Field of the Invention

The present invention generally relates to cooling systems. The present invention more specifically relates to a method of cooling large heat intensive systems.

2. Description of the Related Art

A vapor compression system as known in the art generally includes a compressor, a condenser, and an evaporator. These systems also include an expansion device. In a prior art vapor compression system, a gas is compressed whereby the temperature of that gas is increased beyond that of the ambient temperature. The compressed gas is then run through a condenser and turned into a liquid. The condensed and liquefied gas is then taken through an expansion device, which drops the pressure and the corresponding temperature. The resulting refrigerant is then boiled in an evaporator. This vapor compression cycle is generally known to those of skill in the art.

FIG. 1 illustrates a vapor compression system 100 such as might be found in the prior art. In the prior art vapor compression system 100 of FIG. 1, compressor 110 compresses the gas to (approximately) 238 pounds per square inch (PSI) and a temperature of 190° F. Condenser 120 then liquefies the heated and compressed gas to (approximately) 220 PSI and 117° F. The gas that was liquefied by the condenser 120 is then passed through the expansion valve 130 of FIG. 1. By passing the liquefied gas through expansion valve 130, the pressure is dropped to (approximately) 20 PSI. A corresponding drop in temperature accompanies the drop in pressure, which is reflected as a temperature drop to (approximately) 340F in FIG. 1. The refrigerant that results from dropping the pressure and temperature at the expansion valve 130 is boiled at evaporator 140. Through boiling of the refrigerant by evaporator 140, a low temperature vapor results, which is illustrated in FIG. 1 as having (approximately) a temperature of 39° F. and a corresponding pressure of 20 PSI.

The cycle related to the system 100 of FIG. 1 is sometimes referred to as the vapor compression cycle. Such a cycle generally results in a coefficient of performance (COP) between 2.4 and 3.5. The coefficient of performance, as reflected in FIG. 1, is the evaporator cooling power or capacity divided by compressor power. It should be noted that the temperature and pressure references that are reflected in FIG. 1 are exemplary and illustrative.

FIG. 2 illustrates the performance of a vapor compression system like that illustrated in FIG. 1. The COP illustrated in FIG. 2 corresponds to a typical home or automotive vapor compression system—like that of FIG. 1—with an ambient temperature of (approximately) 90 F. The COP shown in FIG. 2 further corresponds to a vapor compression system utilizing a fixed orifice tube system.

Such a system 100, however, operates at an efficiency rate (i.e., COP) that is far below that of system potential. To compress gas in a conventional vapor compression system 100 like that illustrated in FIG. 1 typically takes 1.75-2.5 kilowatts for every 5 kilowatts of cooling power generated. This exchange rate is less than optimal and directly correlates to the rise in pressure times the volumetric flow rate. Degraded performance is similarly and ultimately related to performance (or lack thereof) by the compressor 110. For example, a prior art compression system 100 as illustrated in FIG. 1 that requires 1.75-2.5 kilowatts to generate 5 kilowatts of cooling power operates at a coefficient of performance (COP) of less than 3.

Haloalkane refrigerants such as tetrafluoroethane ($CH_2FCF_3$) are inert gases that are commonly used as high-temperature refrigerants in refrigerators and automobile air conditioners. Haloalkane refrigerants have also been used to cool over-clocked computers. These inert, refrigerant gases are more commonly referred to as R-134 gases. The volume of an R-134 gas can be 600-1000 times greater than the corresponding liquid.

There is a need in the art for an improved cooling system that more fully recognizes system potential and overcomes technical barriers related to compressor performance. There is a further need for a cooling system that efficiently generates sufficient cooling power to cool large, heat intensive systems.

SUMMARY OF THE CLAIMED INVENTION

Various embodiments of the present invention disclose cooling systems adapted to cool large, heat intensive systems. The cooling system includes a cooling unit that utilizes a supersonic cycle to cool a working fluid in a fluid pathway. As part of the supersonic cycle, a compression wave is generated that causes a pressure change and a phase change in the working fluid. The pressure change and the phase change of the working fluid create a cooling effect in the working fluid. The working fluid is in thermal communication with a heat exchanger that transfers heat generated by the heat intensive system to the cooling unit via a circulating fluid.

Another claimed embodiment of the invention also utilizes a supersonic cycle to cool a working fluid in a fluid pathway. The cooling unit includes a rotating element that accelerates the working fluid to a supersonic velocity. The acceleration of the working fluid creates a compression wave that causes a pressure change and a phase change in the working fluid to cool the working fluid. The working fluid is in thermal communication with a heat exchanger that transmits heat generated by the heat intensive system to the cooling unit via a circulating fluid.

DETAILED DESCRIPTION

Embodiments of the present invention implement a supersonic cooling method that increases efficiency as compared to prior art cooling systems. A system utilizing the present invention may be expected to operate at a COP of 2 or greater, 3 or greater, 4 or greater, 5 or greater, 6 or greater, 7 or greater, 8 or greater, 9 or greater, 10 or greater, or 20 or greater due to the elimination of hardware elements and the implementation of a supersonic cooling cycle.

Figure 2:
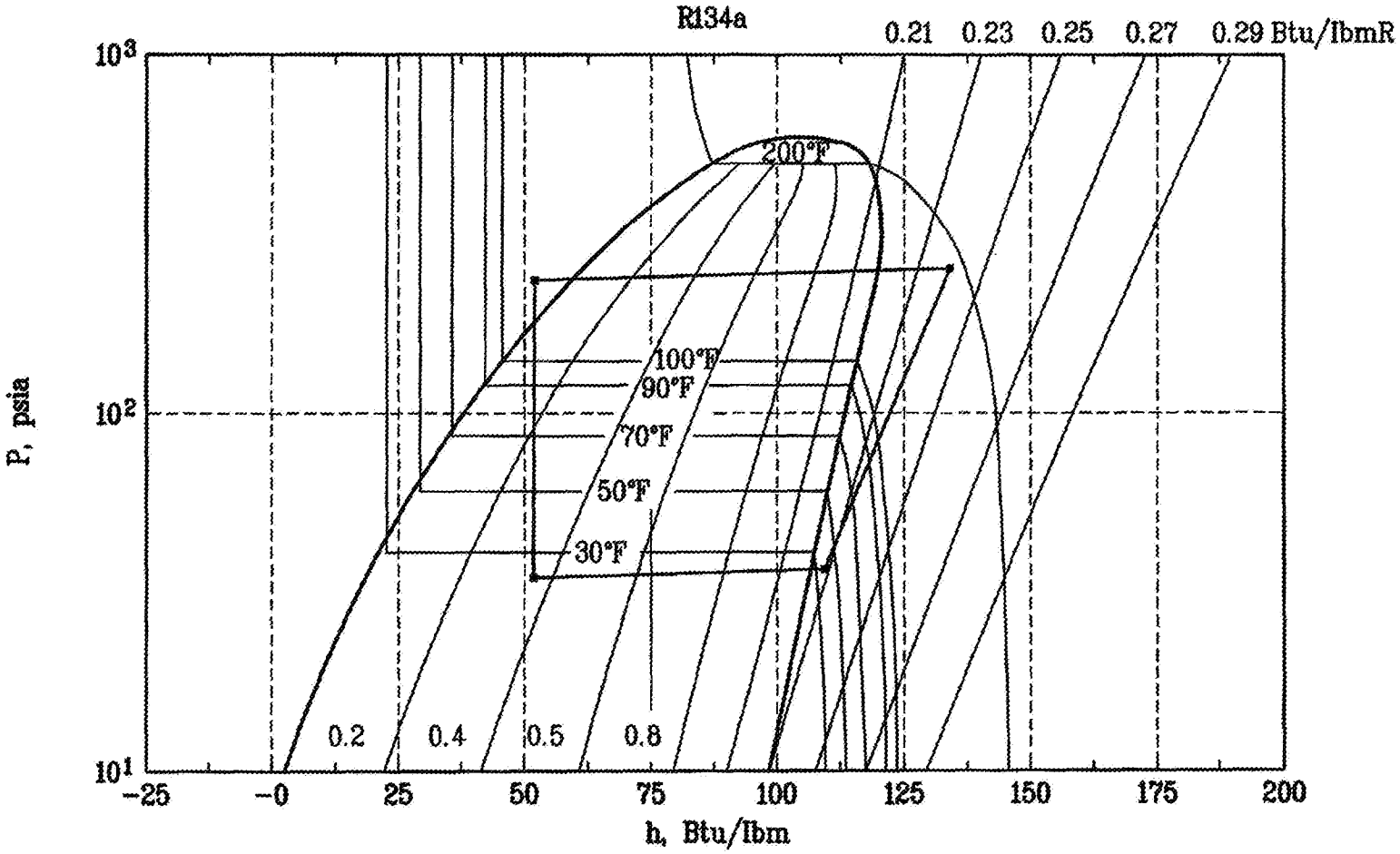
FIG. 2 illustrates the performance of a vapor compression system like that illustrated in FIG. 1.
Figure 3:
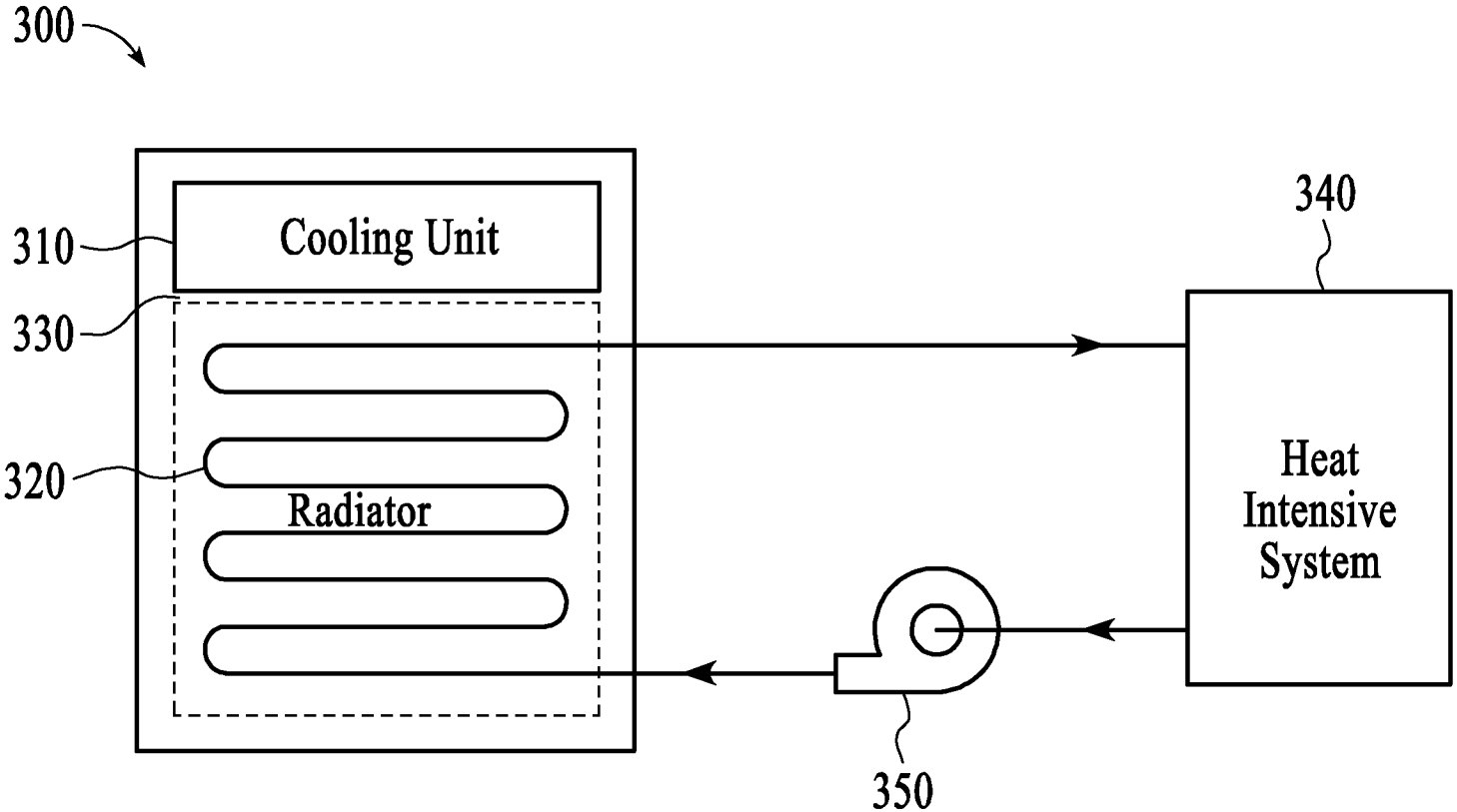
FIG. 3 illustrates an exemplary cooling system.

FIG. 3 illustrates an exemplary cooling system 300. The cooling system 300 of FIG. 2 does not require the compression of a gas as otherwise occurs at compressor 110 in a prior art vapor compression system 100 like that shown in FIG. 1. The cooling system 300 of FIG. 3 operates by pumping or accelerating a working liquid, which may be water. Because cooling system 300 utilizes liquid, the compression cooling system 300 does not require the use of a condenser 120 as does the prior art compression system 100 of FIG. 1. Compression cooling system 300 instead generates a compression wave to create a pressure differential and an accompanying phase change in the fluid.

Cooling system 300, as illustrated in FIG. 3, includes a cooling unit 310. Cooling unit 310 may be constructed in accordance with the various cooling devices described in conjunction with FIGS. 4, 6, and 9. Each of the aforementioned cooling devices generates a cooling effect via a supersonic cooling cycle. The supersonic cooling cycle includes pressure and phase changes in a working fluid to generate a cooling effect. The use of the supersonic cooling cycle increases the efficiency of the system by eliminating at least the standard compressor.

The cooling unit 310 is thermally coupled to a heat exchange mechanism. As illustrated in FIG. 3, the heat exchange mechanism may be a radiator 320. The radiator 320 conducts a circulating fluid, which may be water, into thermal communication with a heat transfer interface 330. The heat transfer interface 330 transfers heat to a cooled working fluid in the cooling unit 310, thereby cooling the circulating fluid. The heat transfer interface 330 may be formed by placing the cooling unit 310 in contact with the heat exchanger 320. The heat transfer interface 330 may include an air gap between the cooling unit 310 and the heat exchanger 320. The air gap may be filled with a heat conductive fluid to improve the heat transfer characteristics.

The circulating fluid as cooled by the cooling unit 310 then flows to an inlet of a heat intensive system 340. Heat intensive system 340 is inclusive of those systems that generate heat during operation, such as computing devices or clusters, laser systems, televisions, gaming consoles, and other consumer electronics. Dissipation of the generated heat may benefit the heat intensive system 340 by helping to avoid overheating.

By dissipating heat from the heat intensive system 340 of FIG. 3, it may be possible to increase an operating speed of the device not only by ensuring that the system does not overheat, but also by actively cooling the system to reduce an operating temperature of the device. A reduced operating temperature may allow an increase in the clock speed of a device. The cooling system 300 dissipates the additional heat generated, maintaining or even reducing a processor temperature, thereby improving performance of the device.

The circulating fluid of cooling system 300 is in thermal communication with to the heat intensive system 340, thereby cooling the system 340. The warmed circulating fluid flows from an outlet of the heat intensive system 340 and is returned to the radiator 320 of the cooling system 300. A pump 350 may be included in the flow path of the circulating fluid to move the circulating fluid through the cooling system 300.

Those skilled in the art will recognize that the heat intensive system 340 may include one or more heat generating devices. Moreover, depending on the capacity of the cooling system 300, multiple flow paths from multiple devices may be utilized to move the working fluid through the radiator 320. The volume and heat content of the working fluid in the flow path may be used as design parameters to determine a cooling capacity of cooling system 300.

Figure 12:
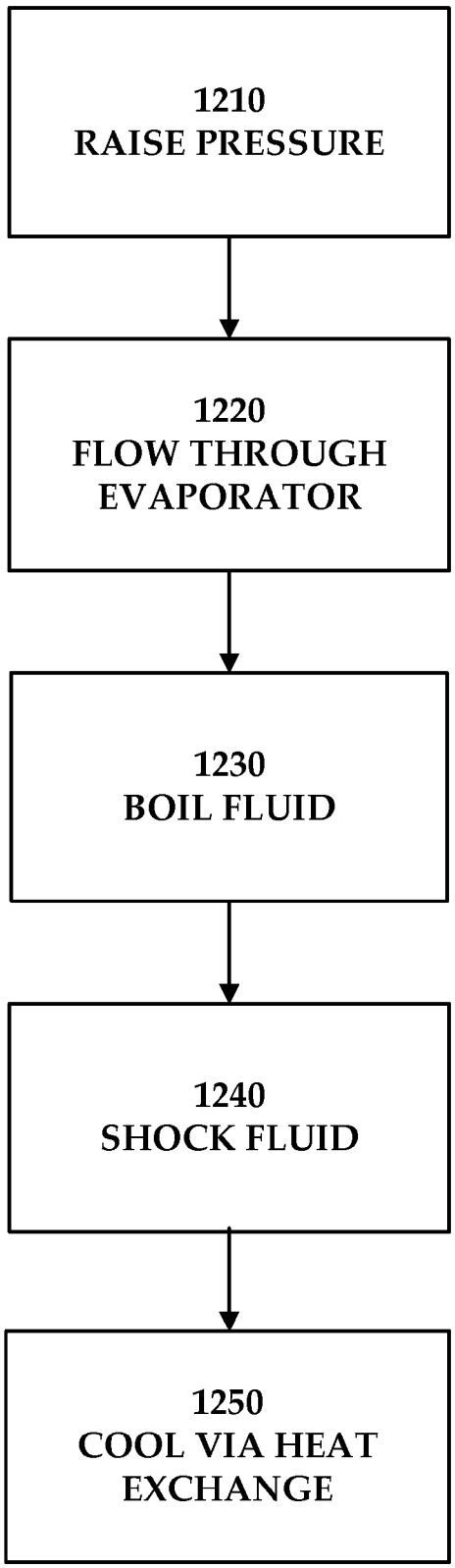
FIG. 12 illustrates the supersonic cooling cycle as generally implemented in the cooling units shown in FIGS. 4, 6, and 9.

Various types of cooling devices may be utilized to cool the working fluid of cooling unit 310, which is in thermal communication with the circulating fluid of the system 300. Each of the devices utilizes the supersonic cooling cycle 1200 illustrated in FIG. 12. In step 1210, the pressure of a liquid, the working fluid, is raised. The pressure may, for example, be raised from 20 PSI to in excess of 100 PSI. The pressure increase may be to 300 PSI or even 500 PSI. In step 1220, fluid flows through the nozzle/evaporator tube(s). A pressure drop and phase change result in a lowered temperature as the working fluid is boiled off in step 1230.

Critical flow rate, which is the maximum flow rate that can be attained by a compressible fluid as that fluid passes from a high pressure region to a low pressure region (i.e., the critical flow regime), allows for a compression wave to be established and utilized in the critical flow regime. Critical flow occurs when the velocity of the fluid is greater or equal to the speed of sound in the fluid. In critical flow, the pressure in the channel will not be influenced by the exit pressure and at the channel exit, the fluid will 'shock up' to the ambient condition. In critical flow the fluid will also stay at the low pressure and temperature corresponding to the saturation pressures. In step 1240, after exiting the evaporator tube, the fluid may "shock" up to 20 PSI.

The working fluid that is cooled in the cooling unit 310 is in thermal communication with the circulating fluid of the cooling system 300. The circulating fluid transfers heat from a heat intensive system via a heat exchanging mechanism in step 1250.

Figure 4:
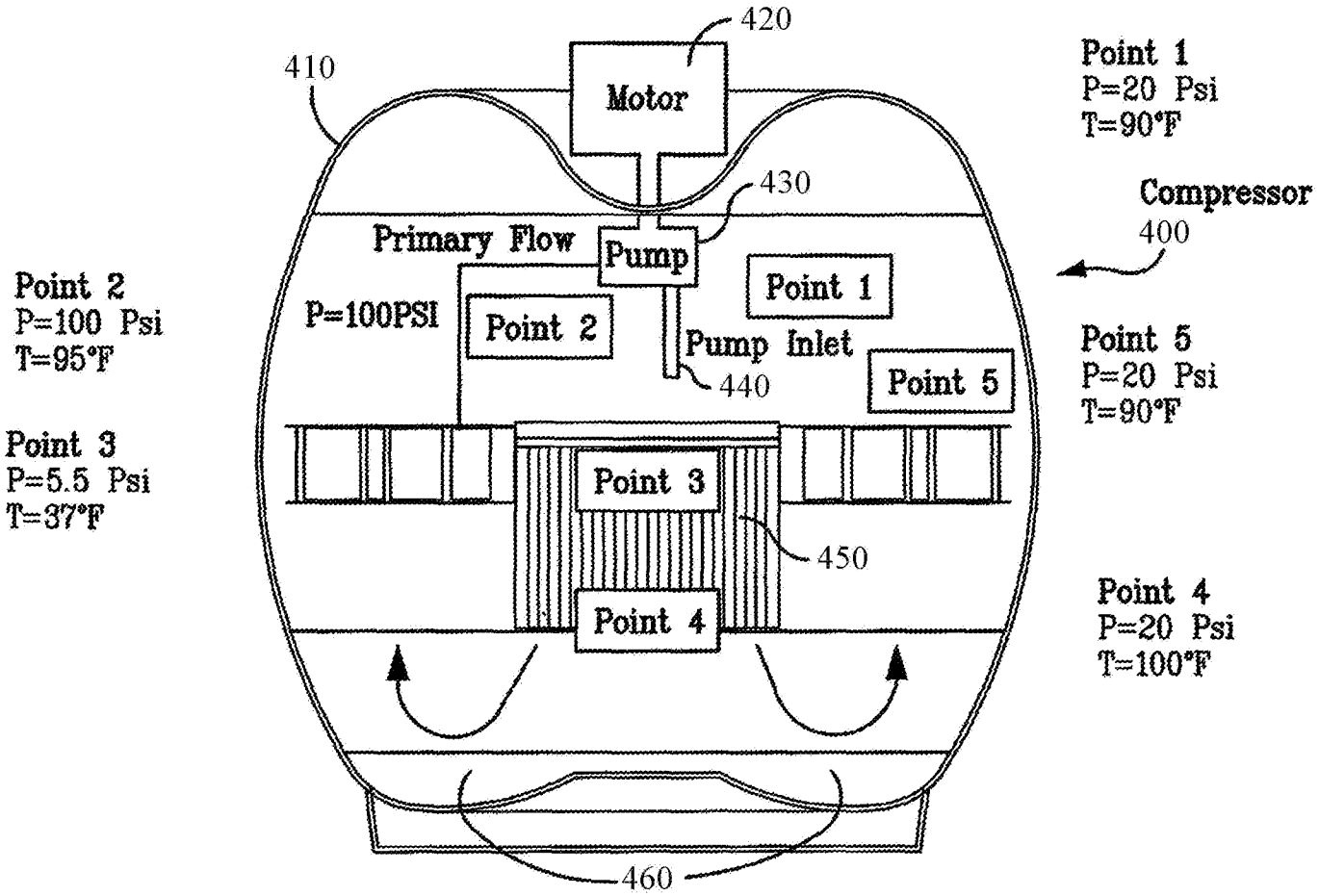
FIG. 4 illustrates a cooling unit utilizing a supersonic cooling cycle.

FIG. 4 illustrates an exemplary cooling device 400 that may be used in cooling unit 310. The cooling device 400 does not need to compress a gas as normally occurs at compressor 110 in a prior art vapor compression system 100 like that shown in FIG. 1. Compression cooling device 400 operates by pumping liquid. Because the cooling device 400 pumps liquid, the compression cooling device 400 does not require the use of a condenser 120 as does the prior art compression system 100 of FIG. 1. Compression cooling device 400 instead utilizes a compression wave. The evaporator of cooling device 400 operates in the critical flow regime where the pressure in an evaporator tube will remain almost constant and then 'jump' or 'shock up' to the ambient pressure.

Figure 1:
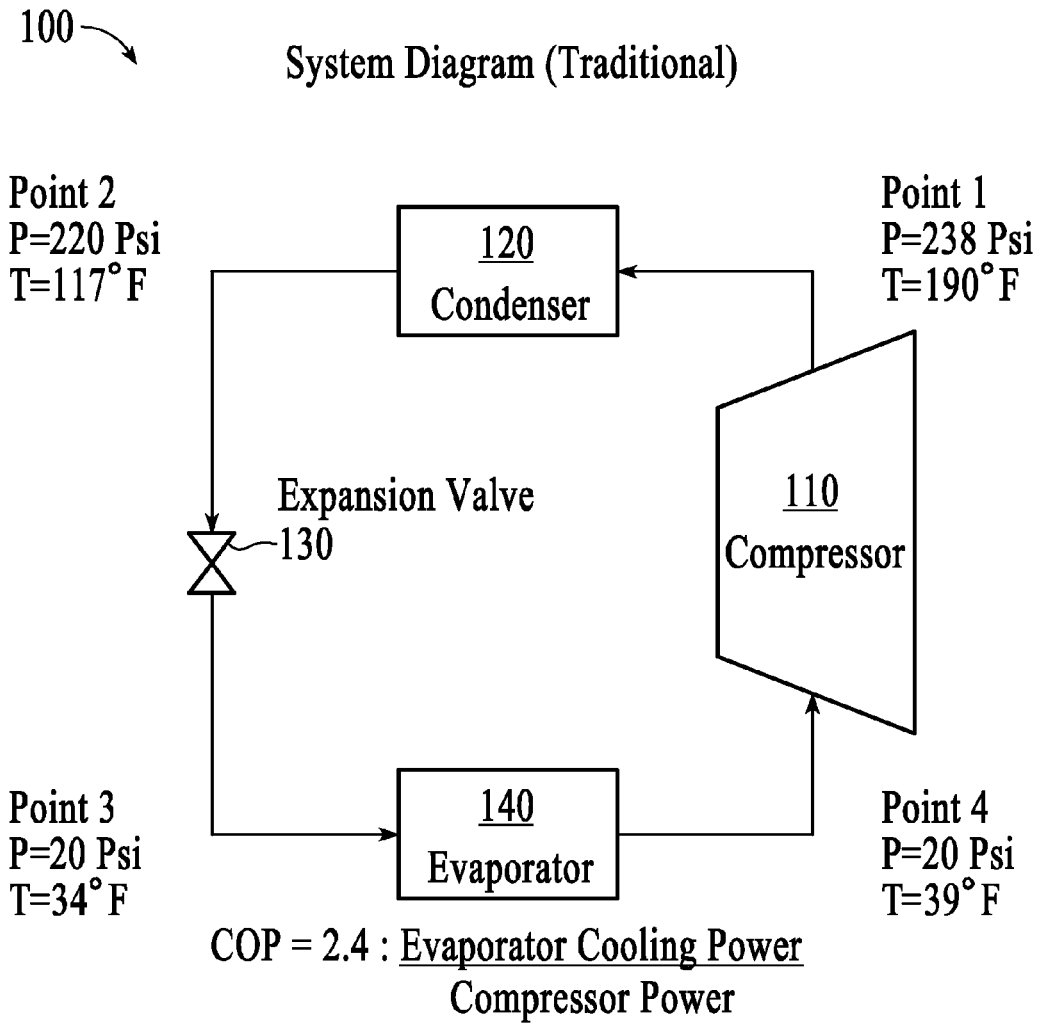
FIG. 1 (PRIOR ART)
FIG. 1 illustrates a prior art vapor compression system.

The cooling device 400 of FIG. 4 recognizes a heightened degree of efficiency in that the pump 420 of the cooling device 400 is not required to draw as much power as the compressor 110 in a prior art compression system 100 like that illustrated in FIG. 1. A compression system designed according to an embodiment of the presently disclosed invention may recognize exponential performance efficiencies. For example, a prior art compression system 100 as illustrated in FIG. 1 may require 1.75-2.5 kilowatts to generate 5 kilowatts of cooling power. Prior art compression system 100 therefore may operate at a coefficient of performance (COP) of less than 3. A cooling system 400 like that illustrated in FIG. 4 may pump fluid from approximately 14.7 to approximately 120 PSI with the pump drawing power at approximately 500 W (0.5 kilowatts), with the system 400 also generating 5 kilowatts of cooling power. The system 400 may therefore operate with a COP of 2 or greater, 3 or greater, 4 or greater, 5 or greater, 6 or greater, 7 or greater, 8 or greater, 9 or greater, 10 or greater, or 20 or greater. Cooling system 400 may utilize many working fluids, including but not limited to water.

The cooling device 400 of FIG. 4 may include a housing 410. Housing 410 of FIG. 4 may be akin to that of a pumpkin. The particular shape or other design of housing 410 may be a matter of aesthetics, or may be defined with respect to where or how the device 400 is installed. The design of the housing 410 may be influenced by the facility in which the device 400 is installed, or by the equipment or machinery to which the device 400 is coupled. Functionally, housing 410 encloses pump 430, evaporator 450, and the attendant accessory equipment or flow paths (e.g., pump inlet 440 and evaporator tube 460). Housing 410 also contains the working fluid to be used by the device 400.

Pump 430 may be powered by a motor 420, which may be external to the device 400 and is located outside the housing 410 in FIG. 4. Motor 420 may alternatively be contained within the housing 410 of system 400. Motor 420 may drive the pump 430 of FIG. 4 through a rotor drive shaft with a corresponding bearing and seal or magnetic induction, whereby penetration of the housing 410 is not required. Other motor designs may be utilized with respect to motor 420 and corresponding pump 430 including synchronous, alternating (AC), and direct current (DC) motors. Other electric motors that may be used with device 400 include induction motors; brushed and brushless DC motors; stepper, linear, unipolar, and reluctance motors; and ball bearing, homopolar, piezoelectric, ultrasonic, and electrostatic motors.

Pump 430 establishes circulation of a compressible fluid through the interior fluid flow paths of device 400, the flow paths being contained within housing 410. Pump 430 may circulate fluid throughout device 400 through use of vortex flow rings. Vortex rings operate as energy reservoirs whereby added energy is stored in the vortex ring. The progressive introduction of energy to a vortex ring via pump 430 causes the corresponding ring vortex to function at a level such that energy lost through dissipation corresponds to energy being input.

Pump 430 also operates to raise the pressure of a liquid being used by device 400 from, for example, 20 PSI to 100 PSI or more. Some systems may operate at an increased pressure of approximately 300 PSI. Other systems may operate at an increased pressure of approximately 500 PSI.

Pump inlet 440 introduces a working liquid to be used in cooling and otherwise resident in device 400 (and contained within housing 410) into pump 430. Fluid temperature may, at this point in the device 400, be approximately 95 F.

Figure 5:
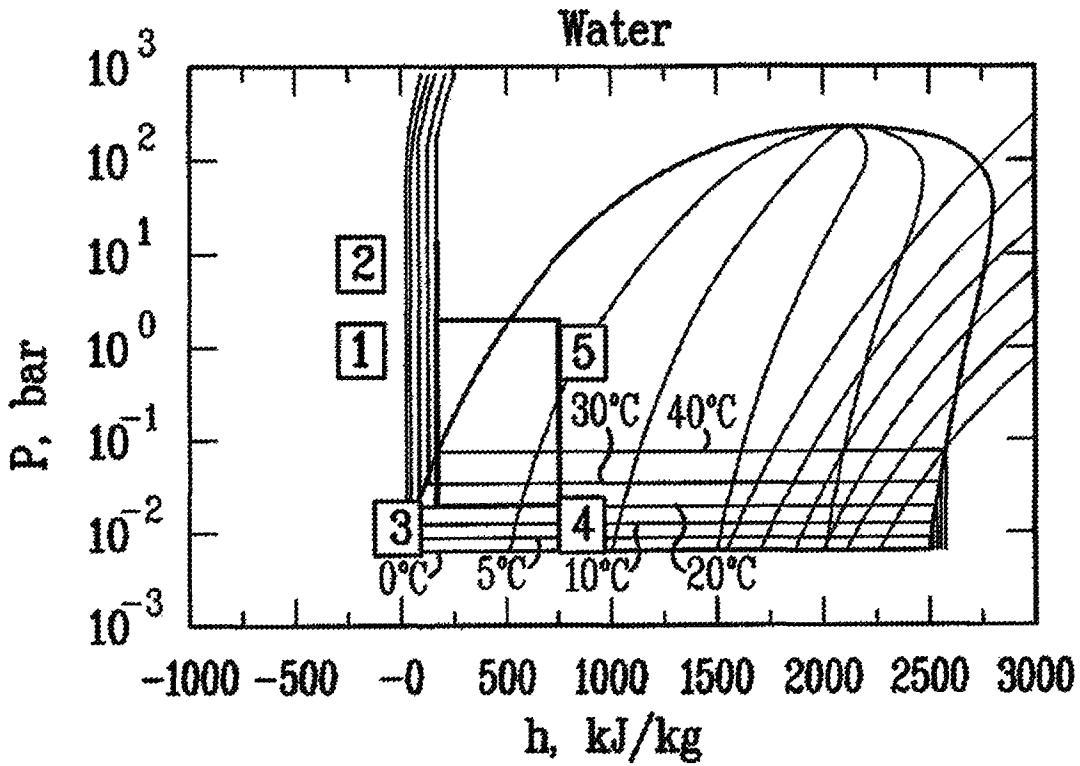
FIG. 5 illustrates the performance of a cooling unit like that illustrated in FIG. 4.

The working fluid introduced to pump 430 by inlet 440 traverses a primary flow path to nozzle/evaporator 450. Evaporator 450 induces a pressure drop (e.g., to approximately 5.5 PSI) and phase change that results in a low temperature. The working fluid further 'boils off' at evaporator 450, whereby the resident liquid may be used as a coolant. For example, the liquid coolant may be water cooled to 35-45° F. (approximately 37° F. as illustrated in FIG. 4). FIG. 5 illustrates an exemplary performance cycle of a cooling system like that illustrated in FIG. 4.

As noted above, the device 400 (specifically evaporator 450) operates in the critical flow regime, thereby generating a compression wave. The working fluid exits the evaporator 450 via evaporator tube 460 where the fluid is 'shocked up' to approximately 20 PSI because the flow in the evaporator tube 460 is in the critical regime. In some embodiments of device 400, the nozzle/evaporator 450 and evaporator tube 460 may be integrated and/or collectively referred to as an evaporator.

Figure 6:
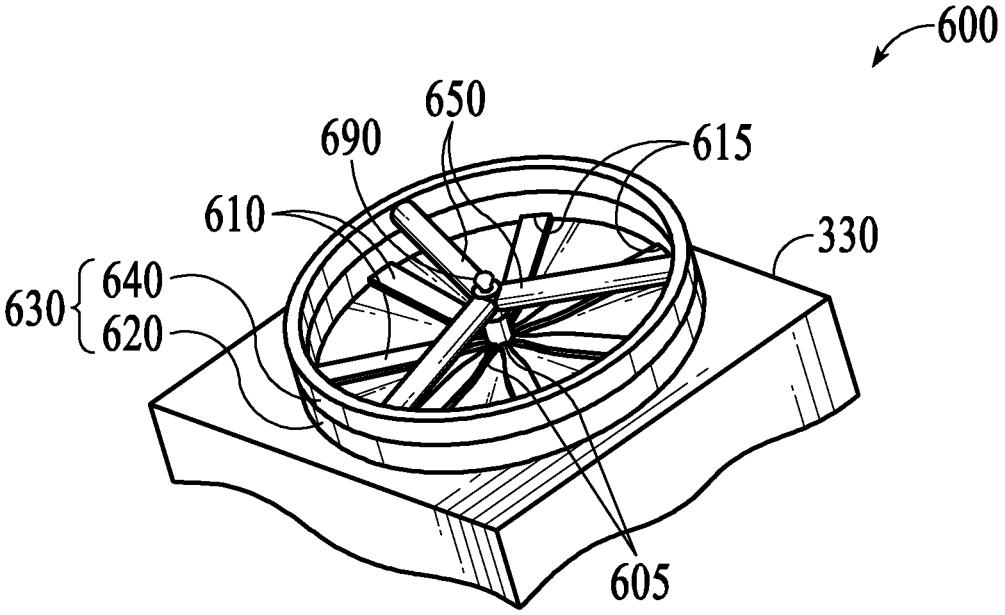
FIG. 6 illustrates a cooling unit utilizing a supersonic cooling cycle that does not require a mechanical pump.

FIG. 6 illustrates another exemplary cooling device 600 that may be used in the cooling unit 310. The cooling device 600 as illustrated in FIG. 6 also does not require the compression of a gas as otherwise occurs at compressor 110 in a prior art vapor compression system 100 like that shown in FIG. 1. The evaporator tubes 610 of the cooling device 600 operate in the critical flow regime of the working fluid, as is disclosed in U.S. patent application Ser. No. 12/732,171, the disclosure of which has been previously incorporated herein by reference. In this regime, the pressure of the fluid in the evaporator tubes 610 will remain almost constant and then 'jump' or 'shock up' to the ambient pressure.

Because the cooling device 600 shown in FIG. 6 accelerates the working fluid through rotational movement, the cooling device 600 does not require the use of a conventional mechanical pump as would a traditional prior art cooling system. The reduced amount of hardware required to operate the device 600—there is no need for a compressor or a conventional mechanical pump—and the implementation of a supersonic cooling cycle gives rise to a greatly improved coefficient of performance (COP).

Figure 7:
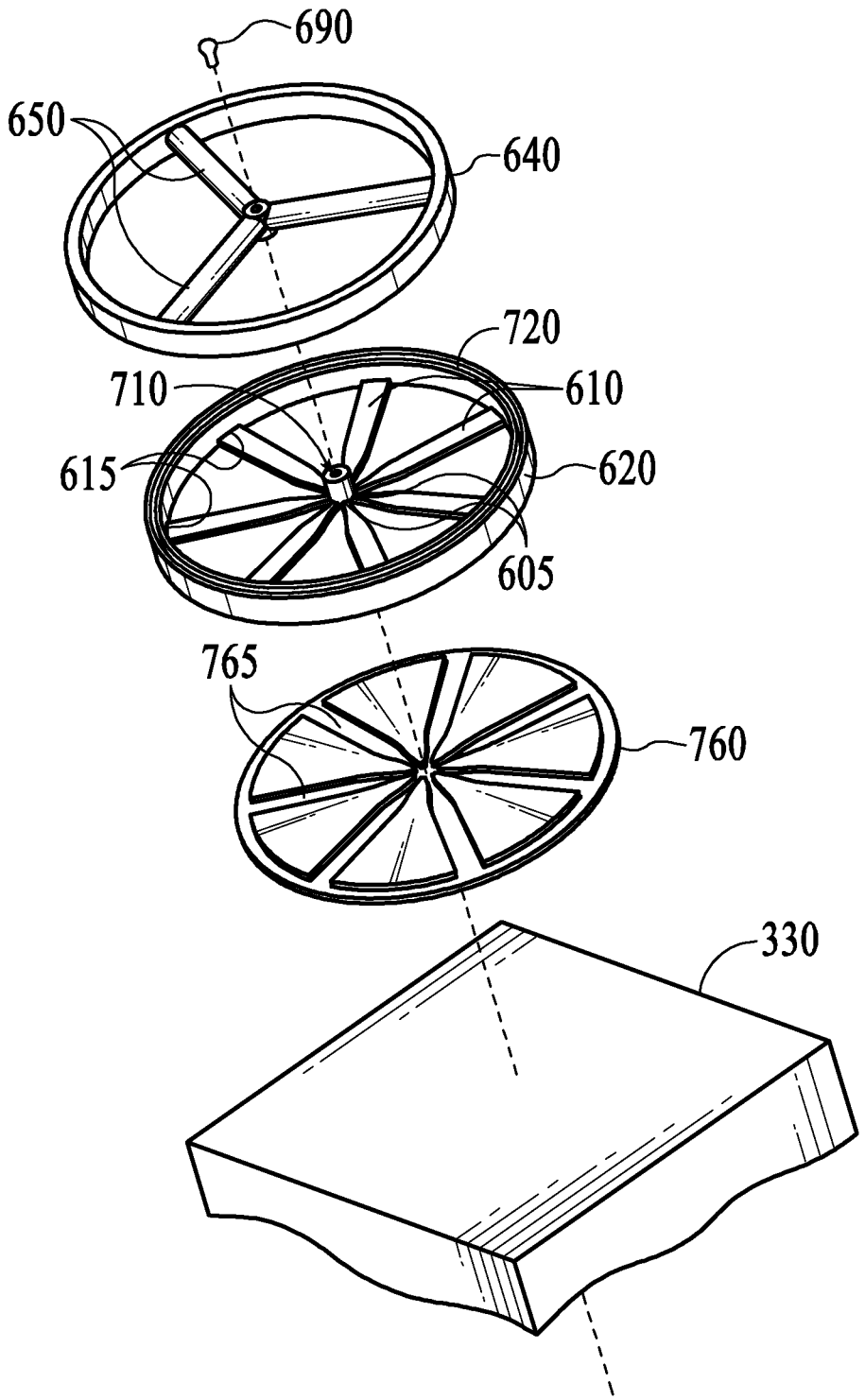
FIG. 7 is an exploded view of the cooling unit illustrated in FIG. 6.

The evaporator tubes 610 may be mounted in a rotating portion 620 of a housing 630. An inlet end 605 of each of the evaporator tubes 610 is in fluid communication with a central throughway 710 (shown in FIG. 7). Outlet ends 615 of each of the evaporator tubes 610 may be in fluid communication with the rotating portion 620 of the housing 630.

The central throughway 710 may be in fluid communication with both the rotating portion 620 and a fixed portion 640 of the housing 630. The fixed portion 640 and the rotating portion 620 of the housing 630 may be coupled in fluid communication via an annular channel as well as via the central throughway 710. The annular channel is formed by the mating of an annular groove in the upper surface of the rotating portion 620 with an annular groove 720 (shown in FIG. 7) in the lower surface of the fixed portion 640.

As the rotating portion 620 spins, the working fluid is introduced to the inlets 605 of the evaporator tubes 610. The motion of the rotating portion 620 accelerates the fluid as it travels through the evaporator tubes 610 outward to the circular perimeter of the rotating portion 620 of the housing 630. (The effects of the fluid flow through the evaporator tubes 610 are described in greater detail below.) After exiting the evaporator tubes 610, the working fluid flows through the annular channel into the fixed portion 640 of the housing 630. The fluid then travels from the fixed portion 640 through one or more hollow spokes 650 in the fixed portion 640, through the central throughway 710, and back to the inlets of the evaporator tubes 610.

The defined fluid pathway is a continuous loop when the rotating portion 620 of the housing 630 is spinning. The centrifugal force generated by the rotation of the rotating portion 620 accelerates the working fluid through the evaporator tubes 610. The working fluid flows through the rotating portion 620 into the fixed portion 640 via the annular groove 720. The acceleration of the working fluid in the evaporator tubes 610 creates suction. The suction draws the fluid through the spokes 650 and back to the central throughway 710. The working fluid flows to the lower end of the central throughway 710 where the fluid is again introduced to the inlets 605 of the evaporator tubes 610.

In the evaporator tubes 610, the fluid reaches the critical flow rate. The critical flow rate is the maximum flow rate that can be attained by a compressible fluid as that fluid passes from a high pressure region to a low pressure region (i.e., the critical flow regime). Critical flow occurs when the velocity of the fluid is greater than or equal to the speed of sound in the fluid. Operating in the critical flow regime allows for a compression wave to be established and utilized in the evaporator tubes 610. In critical flow, the pressure in the tube 610 will not be influenced by the exit pressure. As the fluid exits the evaporator tubes 610, the fluid 'shocks up' to the ambient conditions.

An interface plate 760 may be installed to assist in the exchange of heat from the heat exchanger 320 via the interface 330. The interface plate 760 may be in thermal communication with the rotating portion 620 of the housing 630, either through direct contact or via a thermally conductive connector. The interface plate 760 may be a solid metal disc. The metal may be chosen to have a large heat transfer coefficient. Similarly, materials for the evaporator tubes 610 and for the housing 630 may be chosen based on their weight and heat conducting characteristics. Aluminum is one example of a material that may be chosen to construct the evaporator tubes 610 and the housing 630.

The interface plate 760 may be connected to the rotating portion 620 so that the interface plate 760 also rotates. A connection mechanism may be made by forming depressions 765 in the interface plate 760. The shape of the depressions 765 may conform to the shape of the exterior of the evaporator tubes 610, and the position of the depressions 765 may correspond to the position of the evaporator tubes 610. The rotating portion 620 may therefore be connected to the interface plate 760 by securing the evaporator tubes 610 in the depressions 765 of the interface plate 760.

Heat is transferred through the interface plate 760 from the interface 330. In various installations of the cooling device 600, there may be a narrow air gap between the interface plate and the interface 330. In some embodiments, the gap may be filled with a heat conductive material such as oil.

The motive force required to spin the rotating portion 620 may be supplied utilizing any number of driving mechanisms known to those skilled in the art. Examples of suitable driving mechanisms include an electric motor with a drive axis coaxial with the center of the rotating portion 620 and magnetic elements installed in adjacent faces of the rotating 620 and fixed 640 portions of the housing 630.

The rotational speed to accelerate the working fluid may be influenced by any number of factors, including but not limited to the specific geometry of the cooling device 600, the particular working fluid chosen to be used in the device 600, and the ambient conditions. To effectuate the acceleration of the working fluid, the rotating portion 620 may be rotated at an approximate range of 7,500-10,000 rpm. Depending on the ambient conditions and the specific characteristics of a given application, the rotational speed of the rotating portion 620 may be more then 10,000 rpm or less than 7,500 rpm.

As the rotating portion spins, axial velocity urges the working fluid to collect at the trailing sides of the evaporator tubes 610. To maintain a proper flow pattern through the evaporator tubes 610, the evaporator tubes 610 may be arced to compensate for the pooling effect of the axial velocity.

The cooling device 600 may be modified according to the requirements of a given installation. The size and number of evaporator tubes 620, the dimensions of the housing 630, use of an interface plate 760 and an air gap 680, may all be adjusted depending on how much heat is being generated by the heat intensive system 340 and the desired operating temperature.

As explained in further detail below, a phase change occurs in the working fluid as the fluid passes through the evaporator tubes 610. The phase change involves a sudden and significant change in volume in the fluid. To accommodate the volume change, a mechanism 690 to compensate for volume change may be provided. The volume change compensation mechanism 690 is installed in fluid communication with the fluid pathway. One volume change compensation mechanism 690 that may be utilized is an expandable bladder.

Figure 8:
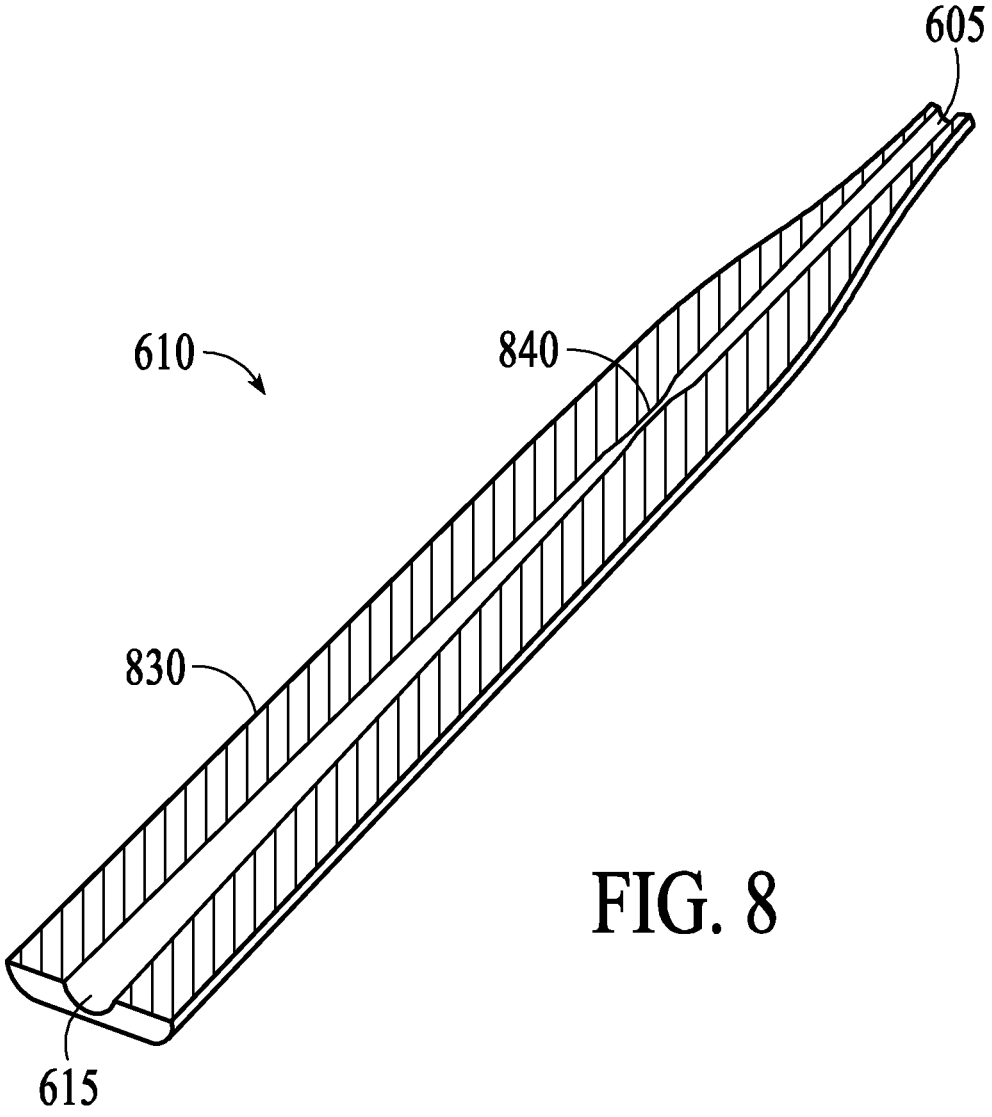
FIG. 8 illustrates a cross sectional view of an evaporator nozzle as may be utilized in the cooling units illustrated in FIGS. 4, 7, and 8.

FIG. 8 is a cross sectional view of an evaporator tube 610. The tube 610 of FIG. 8 includes the inlet 605 and the outlet 615 formed inside the tube body 830. A throat section 840 causes the working fluid to accelerate to a speed equal to or greater than the speed of sound in the working fluid after the working fluid enters the tube 610. The acceleration of the working fluid through the throat section 840 causes a sudden drop in pressure, which may result in cavitation. These factors may assist in the formation of the compression wave in the evaporator tube 610.

The flow of the working fluid through the evaporator tube 610 induces a pressure drop and phase change in the working fluid that results in a lowered temperature, providing the cooling effect of the device 600. The pressure change may span a range of approximately 20 PSI to 100 PSI. In some instances, the pressure may be increased to more than 100 PSI, and in some instances, the pressure may be decreased to less than 20 PSI. The pressure change of all the cooling systems described herein may be in this range of change, or may exceed the range described immediately above.

Figure 9:
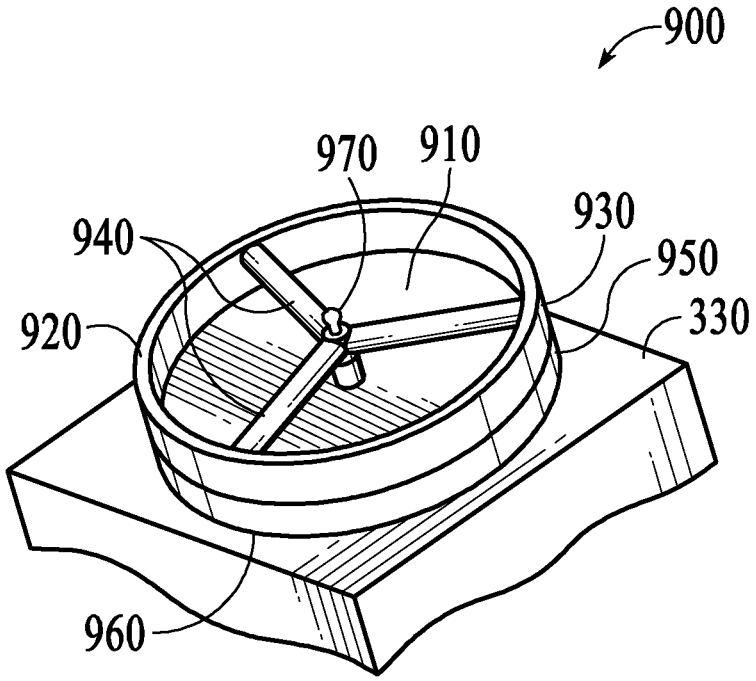
FIG. 9 illustrates a cooling unit utilizing a supersonic cooling cycle that does not include an evaporator nozzle.
Figure 10:
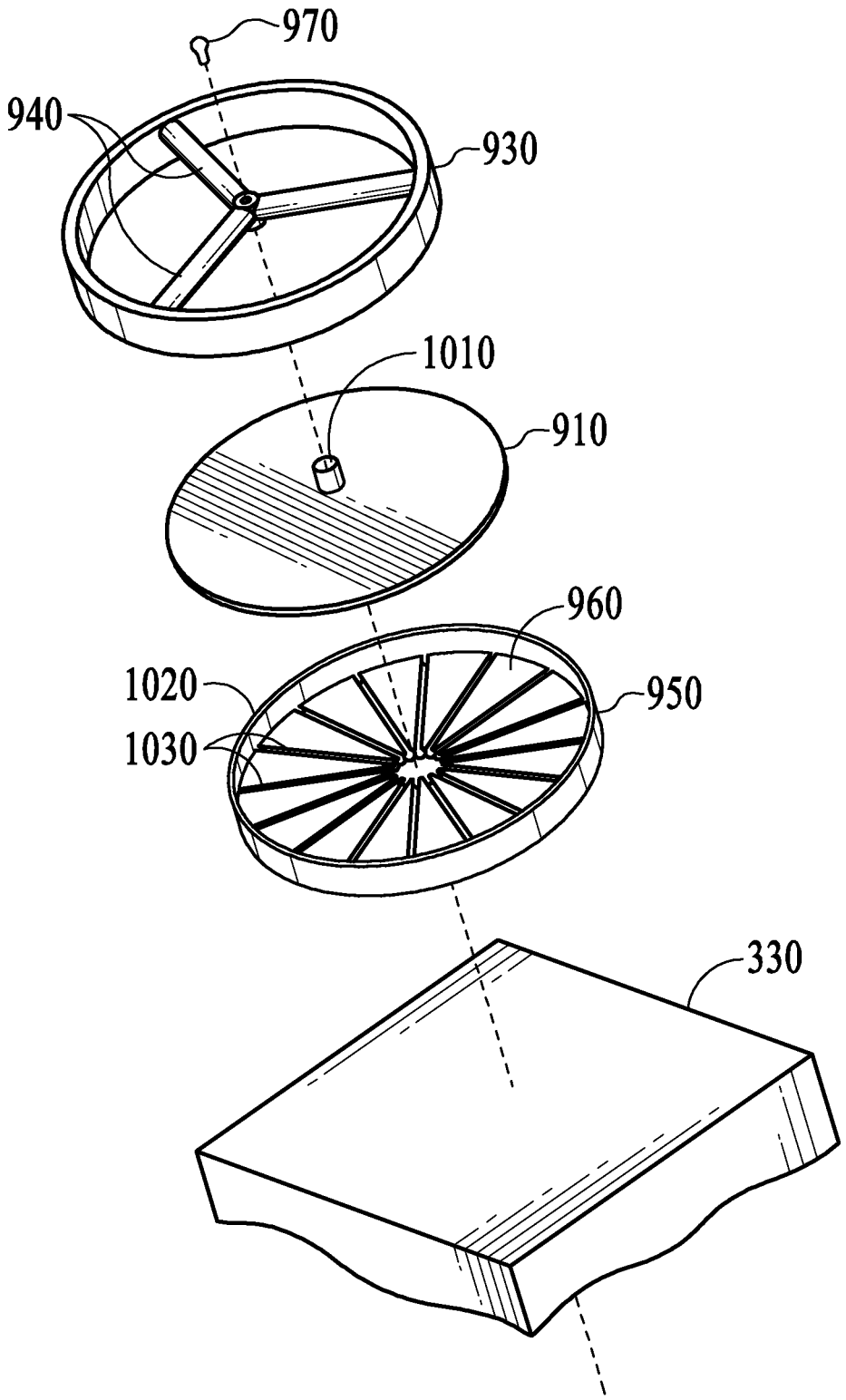
FIG. 10 is an exploded view of the cooling unit illustrated in FIG. 9.
Figure 11:
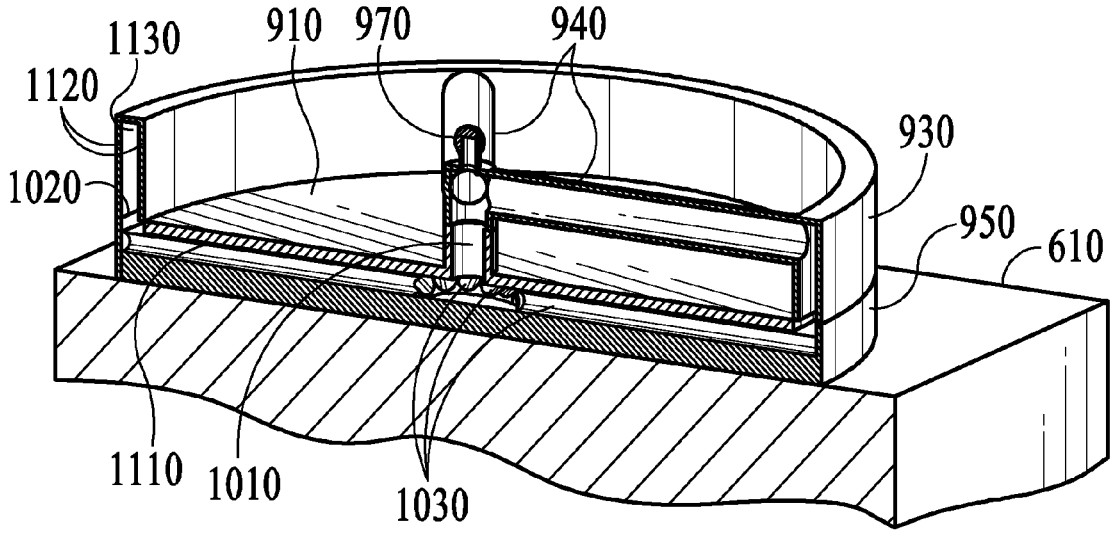
FIG. 11 illustrates a cross sectional view of the cooling unit illustrated in FIG. 10.

FIGS. 9-11 illustrate another exemplary cooling device 900 that may be used in cooling unit 310. The cooling device 900 does not need to compress a gas as otherwise occurs at compressor 110 in a prior art vapor compression system 100 like that shown in FIG. 1. Cooling device 900 operates by accelerating a working liquid, which may be water, in an acceleration chamber 1110 (shown in FIG. 11). Because cooling device 900 utilizes liquid, the compression cooling device 900 does not require the use of a condenser 190 as does the prior art compression system 100 of FIG. 1. The compression cooling device 900 instead utilizes a rotating disk 910 that accelerates the working fluid to generate a compression wave.

The cooling device 900 operates in the critical flow regime of the working fluid. In this regime, the pressure of the fluid in the device 900 will remain almost constant and then 'jump' or 'shock up' to the ambient pressure. Further, because cooling device 900 accelerates the working fluid through rotational movement of the disk 910, cooling device 900 does not require the use of a conventional mechanical pump. The reduced amount of hardware required to operate the device 900—there is no need for a compressor or a conventional mechanical pump—gives rise to a greatly improved coefficient of performance (COP) for the device 900.

The rotating disk 910 may be mounted in a device housing 920. The motive force required to spin the rotating disk 910 may be supplied by any number of driving mechanisms known to those skilled in the art. Examples of suitable driving mechanisms include an electric motor with a drive axis coaxial with the center of the rotating disk 910 and magnetic elements installed in adjacent faces of the rotating disk 910 and a base of a housing enclosing the device.

An upper section 930 of the housing 920 may include a pair of spaced apart annular walls 1120 sealed at an upper end to form a portion of a fluid pathway 1130 (see FIG. 11). The upper section 930 of the housing 920 may include one or more hollow spokes 940. The hollow spokes 940 extend from an inner annular wall of the upper section 930 to a central throughway 1010 (see FIG. 10). The hollow spokes 940 may form a part of the fluid pathway 1130, and may channel fluid from the outer circumference of the upper section 930 to the central throughway 1010.

A lower section 950 of the housing 920 includes a base plate 960 with an upwardly extending annular wall 1020. The annular wall 1020 of the lower section 950 contacts the outer annular wall 1120 of the upper section 930, thereby continuing the fluid pathway 1130 from the annular walls 1120 of the upper section 930. The contact line—the seam—between the upper section 930 and the lower section 950 may be sealed to prevent leakage of the working fluid from the fluid pathway 1130 (see FIG. 11).

The underside of the rotating disk 910 is spaced apart from the base plate 960 to form the acceleration chamber 1110. The height of the acceleration chamber 1110 may be chosen so that shear forces generated in the acceleration chamber 1110 create a cavitation effect in the working fluid as the fluid accelerates across the face of rotating disk 910.

An upper surface of the base plate 960 may include one or more grooves 1030 that form a secondary flow path. Outer ends of the grooves 1030 may open into the fluid pathway 1130 bounded by the annular wall 1020. Inner ends of the grooves 1030 open into the central throughway 1010 (see FIG. 10). Fluid flowing through the grooves 1030 may behave like a hydraulic bearing to assist fluid flow through the acceleration chamber 1110. The grooves 1030 may be arced to compensate for axial velocity of the rotating disk 910.

In an embodiment of the device 900 that utilizes a rotating disk 910 that is approximately 0.9 m in diameter, the height of the acceleration chamber 1110—the separation between the rotating disk 910 and the base plate 960 of the lower section 950 of the housing 920—may be 1.6 mm. The rotational speed necessary to generate the desired shear force in the acceleration chamber is a function of the device parameters, including size, material and conformation of the rotating disk 910, and the working fluid selected. When water is used as the working fluid in a device 900 with a 0.9 m rotating disk 910 and an acceleration chamber 1110 that is 1.6 mm in height, the desired shear force may be generated by spinning the rotating disk 910 at between approximately 7,500 rpm and approximately 10,000 rpm. Any and all of the physical dimensions and operating characteristics of the device 900 may be modified to meet the requirements of any particular installation.

The base plate 960 that forms the bottom of the lower section 950 of the housing 920 may be mounted directly on the interface 330 of the heat exchanger 320. A thermally conductive element may be placed between the base plate 960 and the interface 330. As long as the base plate 960 is in thermal communication with the interface 330, the device 900 will achieve the desired heat exchange between the cooled working fluid and the heat exchanger 320. Materials used to construct the device 900 may be chosen on the basis of their thermal conductivity and physical properties. Aluminum may be selected as the primary material from which the device 900 is constructed.

The fluid pathway 1130 may be seen as beginning at a point at which the central throughway 1010 opens into the acceleration chamber 1110. Fluid is accelerated outward from this point by the rotation of disk 910. The fluid flows toward the annular wall 1020 of the lower section 950 of the housing 920. Suction created by the acceleration of the fluid causes the fluid to flow upward between the annular walls 1120 of the upper section 930. The fluid then flows inward through the spokes 940 back to the central throughway 1010.

A phase change occurs in the working fluid as the fluid is accelerated in the acceleration chamber 1110. The phase change involves a sudden and significant change in volume in the fluid. To accommodate the volume change, a mechanism 970 to compensate for volume change may be provided. The volume change compensation mechanism 970 is installed in fluid communication with the fluid pathway. One volume change compensation mechanism 970 that may be utilized is an expandable bladder coupled to the central throughway 1010.

As the working fluid travels through the fluid pathway 1130, the device 900 generates a cooling effect. The pressure change of the fluid in the device 900 may include a range of approximately 20 PSI in the low pressure region to 100 PSI in the high pressure region. In some instances, the pressure may be increased to more than 100 PSI, and in some instance, the pressure may be decreased to less than 20 PSI. Depending upon the characteristics of a given installation of the device, the pressure change range may vary from that described immediately above.

While various embodiments have been described above, it should be understood that they have been presented by way of example only, and not limitation. The descriptions are not intended to limit the scope of the invention to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the invention as defined by the appended claims and otherwise appreciated by one of ordinary skill in the art. The scope of the invention should, therefore, be determined not with reference to the above description, but instead should be determined with reference to the appended claims along with their full scope of equivalents.

What is claimed is:

1. A cooling system for cooling heat intensive systems, the cooling system comprising:

a cooling unit that utilizes a supersonic cycle to cool a working fluid in a closed-loop fluid pathway, wherein the supersonic cycle generates a compression wave that causes pressure and phase changes in the working fluid, thereby cooling the working fluid; and a heat exchanger that transfers heat generated by the heat intensive system to the cooling unit via a circulating fluid that is in thermal communication with the working fluid; and wherein a mechanical pump is used to increase the pressure of the working fluid at an inlet of at least one evaporator tube without the fluid passing through an intermediate heater, fluid flow within the at least one evaporator tube being in the critical flow regime and causing a phase change in the working fluid.

2. The cooling system of claim 1, wherein at least a portion of a fluid flow in the cooling unit is in the critical flow regime.

3. The cooling system of claim 1, wherein at least a portion of the fluid flow is propelled by vortex flow rings.

4. The cooling system of claim 1, wherein the working fluid is accelerated by rotating a portion of the fluid pathway so that the working fluid is accelerated to a velocity greater than or equal to the speed of sound in the fluid.

5. The cooling system of claim 4, wherein the fluid pathway includes at least one evaporator tube.

6. The cooling system of claim 1, wherein cavitation generated in the fluid pathway assists in the formation of the compression wave.

7. The cooling system of claim 1, wherein during the phase change of the working fluid, a portion of the working fluid is introduced into a volume change compensation mechanism in fluid communication with the fluid pathway to compensate for the volume change associated with the phase change.

8. The cooling system of claim 1, wherein the working fluid is water.

9. The cooling system of claim 1, wherein a rotating disk is positioned in communication with the fluid pathway, and wherein the working fluid is introduced at a central area of the rotating disk so that acceleration of the working fluid across a face of the rotating disk causes the working fluid to flow in the critical flow regime.

10. The cooling system of claim 9, wherein the flow of the working fluid across the face of the rotating disk creates a shear force that generates cavitation in the working fluid.

11. The cooling system of claim 1, wherein acceleration of the working fluid causes a pressure change that leads to a phase change of the working fluid.

12. The cooling system of claim 11, wherein the pressure change of the working fluid occurs within a range of approximately 20 PSI to approximately 100 PSI.

13. The cooling system of claim 11, wherein the pressure change of the working fluid involves a change to an excess of 100 PSI.

14. The cooling system of claim 11, wherein the pressure change of the working fluid involves a change to less than 20 PSI.

15. A cooling system for cooling heat intensive systems, the cooling system comprising:

a cooling unit that utilizes a supersonic cycle to cool a working fluid in a closed-loop fluid pathway, the cooling unit utilizing a rotating element to accelerate the working fluid to a supersonic velocity, the acceleration of the working fluid creating a compression wave that causes a phase change in the working fluid, thereby cooling the working fluid; and a heat exchanger in thermal communication with the fluid pathway, the heat exchanger transferring heat generated by the heat intensive system to the cooling unit via a circulating fluid; and wherein a mechanical pump is used to increase the pressure of the working fluid at an inlet of at least one evaporator tube without the fluid passing through an intermediate heater, fluid flow within the at least one evaporator tube being in the critical flow regime and causing a phase change in the working fluid.

16. The cooling system of claim 15, wherein at least a portion of a fluid flow in the cooling unit is in the critical flow regime.

17. The cooling system of claim 15, wherein cavitation generated in the fluid pathway assists in the formation of the compression wave.

18. The cooling system of claim 15, wherein during the phase change of the working fluid, a portion of the working fluid is introduced into a volume change compensation mechanism in fluid communication with the fluid pathway to compensate for the volume change associated with the phase change.

* * * * *